United States Patent [19]

Lelental et al.

[11] 4,307,168

[45] Dec. 22, 1981

[54] AMPLIFICATION OF DEVELOPED ELECTROGRAPHIC IMAGE PATTERNS

[75] Inventors: Mark Lelental, Penfield; Joseph Y. Kaukeinen, Rochester, both of N.Y.

[73] Assignee: Eastman Kodak Company, Rochester, N.Y.

[21] Appl. No.: 794,183

[22] Filed: May 5, 1977

[51] Int. Cl.[3] ..... G03G 9/16; G03G 13/22

[52] U.S. Cl. ..... 430/97; 430/117; 430/120; 430/110; 430/115; 430/414; 430/447

[58] Field of Search ..... 96/1 SD, 1 PE, 1 PS, 96/48 PD; 252/62.1; 427/16, 18, 20, 21; 106/20; 430/97, 110, 115, 120

[56] References Cited

U.S. PATENT DOCUMENTS

| | | | |
|---|---|---|---|
| 3,150,976 | 9/1964 | Johnson | 252/62.1 |
| 3,215,527 | 11/1965 | Johnson | 252/62.1 X |
| 3,231,374 | 1/1966 | Sciambi | 252/62.1 X |
| 3,280,036 | 10/1966 | Howell | 252/62.1 P |
| 3,719,490 | 3/1973 | Yudelson et al. | 96/48 PD |
| 3,826,652 | 7/1974 | Bissonette | 96/48 PD |

FOREIGN PATENT DOCUMENTS

| | | |
|---|---|---|
| 674549 | 11/1963 | Canada . |
| 935014 | 10/1973 | Canada . |
| 1431699 | 4/1976 | United Kingdom . |

*Primary Examiner*—John D. Welsh
*Attorney, Agent, or Firm*—John R. Everett

[57] ABSTRACT

Electrographic image patterns are developed using marking particles containing a catalyst or catalyst precursor. The developed image pattern is then amplified by contacting it with high gain chemical-redox amplification composition.

18 Claims, No Drawings

AMPLIFICATION OF DEVELOPED ELECTROGRAPHIC IMAGE PATTERNS

FIELD OF THE INVENTION

This invention relates to electrographic marking particles, developer compositions and processes.

BACKGROUND OF THE INVENTION

Electrographic imaging and developing processes have been extensively described in both the patent and other literature. Such electrographic imaging and development processes include the imaging and development processes of electrophotography, electrophoretic migration imaging and modulated electrostatic printing.

A typical electrophotographic process employs a photoconductive element comprising a coating of a photoconductive insulating material on a conductive support. The element is given a uniform charge in the dark and then is exposed to an image pattern of activating electromagnetic radiation such as white light or X-rays. The charge on the photoconductive element is dissipated in the illuminated areas to form an electrostatic charge pattern which is then developed by contact with a developer composition comprising a carrier and an electrographic marking material. The marking particles deposit on the surface bearing the electrostatic charge pattern, in accordance with either the charge pattern or the discharge patterns as desired.

In a typical electrophoretic migration imaging process, an imaging composition comprising electrostatic charge-bearing photoconductive particles, i.e. electrically photosensitive particles, is positioned between two spaced electrodes, one of which may be transparent. To achieve image formation in this process, the electrically photosensitive particles positioned between the two spaced electrodes are subjected to the influence of an electric field and exposed to a pattern of activating radiation. As a result, the electrically photosensitive particles are caused to migrate electrophoretically to the surface of one or the other of the spaced electrodes upon which an image of the pattern of activating radiation is defined by the electrically photosensitive particles. Typically, a negative image of the pattern is formed on one electrode, and a positive image of the pattern is formed on the opposite electrode.

One method of modulated electrostatic printing referred to in the patent literature comprises generating an ion stream in the direction of a print receiving medium, modulating the cross-sectional density flow of ions in the stream in accordance with a pattern to be reproduced, and introducing a cloud of substantially uncharged marking particles adjacent to print receiving medium whereby the modulated ion stream selectively collides with and induces charges on the marking particles in the cloud. The marking particles are then deposited on the printing receiving medium in accordance with the pattern being reproduced. The direction of the ion stream flow is determined by an electrical field. The ion stream is modulated in accordance with the charge pattern by a grid having computer addressed electronic gates.

Sometimes developed electrographic images have a low maximum density. This low maximum density can result from a variety of reasons. In the case of photoelectrophoretic imaging, it might relate to the nature of the pigment used in or as the electrically photosensitive component of the imaging composition, or the relatively large mass of electrically photosensitive marking materials which must be caused to migrate to establish optimum density. In the case of developing electrostatic images with liquid aerosol developers, the low maximum density might result from low solubility of the dye in the carrier. In other cases, the charge density defining the latent electrostatic image may be so low as to be unable to attract sufficient marking particles to obtain an optimum maximum density. The low charge density of the latent image can result from a variety of factors including insufficient exposure and/or insufficient insulating capability of the surface upon which the latent charge image is placed.

It is frequently desirable to increase the density of an already developed charge image.

SUMMARY OF THE INVENTION

We have discovered that under the influence of an electrical field, electrographic marking particles comprising a catalyst or a catalyst precursor can be deposited in accordance with an image pattern upon a receiver surface where subsequently said catalyst or catalyst precursors may be used to amplify the image pattern after development. The amplification may be carried out by using a variety of high gain chemical redox amplification methods such as physical development.

The phrase "electrographic marking particles" is used herein broadly to include electrically photosensitive particles used in migration imaging processes and any other material used to develop and define a latent electrographic image pattern such as, for an example, electrographic toners, liquid droplets, resin or polymer particles. Such marking particles may be a composite particle and may contain a colorant. The marking particles are typically, although not necessarily, brought into contact with the image pattern in an electrographic developer composition comprising a carrier vehicle and the marking particle.

The phrase "electrographic developer composition" includes any composition comprising a carrier and the electrographic marking particles of the present invention and is intended for use in developing electrographic image patterns, however formed, including but not limited to, the methods of electrophotographic, electrophoretic migration imaging and modulated electrostatic printing.

In general, the novel electrographic marking particles of the present invention can be used to increase the speed of electrographic processes and/or the maximum optical density of any electrographic image pattern regardless of how the image pattern is formed if the image pattern is developed with marking particles.

PREFERRED EMBODIMENTS

According to one embodiment of the present invention, electrographic marking particles are provided which comprise a catalyst or catalyst precursor consisting of a metal or metal compound wherein said metal is selected from the group of metals forming Group VIII and IB of the Periodic Table, including alloys and mixtures of such metals. Especially useful catalyst or catalyst precursors consist of metals and metal compounds selected from the group consisting of copper, silver, cobalt, nickel, rhodium, gold, palladium, tellurium alloys and mixtures of such metals.

According to another embodiment of the present invention, electrographic developer compositions are provided comprising a carrier and the electrographic marking particle of the present invention.

According to yet another embodiment of the present invention, a method is provided for amplifying a developed electrographic image pattern which resides upon an insulated receiver comprising the steps of:

(a) contacting a charge pattern with an electrographic developer composition comprising a carrier and charged electrographic marking particles, according to the present invention thereby forming said developed image pattern; and (b) contacting said developed image pattern with a high gain chemical-redox amplifier in composition thereby amplifying said developed image pattern.

According to yet another embodiment of the present invention a method is provided for amplifying a developed electrographic image pattern comprising the steps of:

(a) contacting a charge pattern with a developer composition comprising a carrier and neutral electrographic marking particle of the present invention thereby charging said particles;

(b) depositing said charged particles on a receiver surface thereby forming said developed electrographic image pattern; and (c) contacting the developed image pattern while on the receiver surface with a high gain chemical-redox amplification composition thereby amplifying said developed image pattern.

According to yet another embodiment of the present invention, a method is provided for amplifying an image pattern formed in an electrophoretic migration imaging process comprising the steps of:

(a) subjecting an electrically photosensitive material positioned between at least two electrodes to an applied electric field, wherein said electrically photosensitive material contains a catalyst or catalyst precursor;

(b) exposing said material to an image pattern of radiation to which the material is photosensitive, thereby obtaining a developed image pattern on at least one of said electrodes; and (c) contacting the developed image pattern with a high gain chemical-redox amplification composition thereby amplifying the developed image pattern.

The invention will be described and illustrated herein in connection with the development and amplification of charge patterns by the techniques of electrophotography, electrophoretic migration imaging and modulated electrostatic printing. It will be readily understood by those skilled in the art that the invention will be in general, applicable to any electrographic technique which uses marking particles for defining image patterns. The present invention will also be described herein in connection with electrographic developer compositions comprising liquid carriers. It is clear, as explained hereinafter that the invention will be equally useful in developer compositions comprising dry carrier material.

In general the catalysts or catalyst precursors which are useful in the present invention may be chosen from any of the materials known to be useful as catalysts or catalyst precursors in image forming oxidation-reduction processes such as the processes described in U.S. Pat. No. 3,427,706 by Shepard et al., issued Feb. 25, 1969; U.S. Pat. No. 3,152,904 by Sorensen et al., issued Oct. 13, 1964; U.S. Pat. No. 3,152,903 by Shepard et al., issued Oct. 13, 1964; U.S. Pat. No. 3,765,890 by Weyde et al., issued Oct. 16, 1973; and U.S. Pat. No. 3,674,490 by Matejec et al., issued July 14, 1972. Typical catalysts or catalyst precursors include elements and compounds formed therefrom, such as the elements forming Group IB and VIII of the Periodic Table, vandium, titanium, chromium, iron, zinc, germanium, cadmium, selenium, tin, tellurium, rhenium and lead. Choice of the particular catalyst or catalyst precursor will, of course, be dictated by the particular image forming reaction which one desires to initiate and the high gain chemical redox amplification method used.

Suitable catalyst precursors which are useful in the present invention include metal compounds, complexes, coordination compounds and organometallic compounds. Typical materials include for an example the palladium compounds described in U.S. Pat. No. 3,598,587 having the general formula $[Pd(L)_x]_yM_2$, Cu(I) and Cu(II); compounds described in U.S. Pat. Nos. 3,989,732; 3,927,055; 3,860,501; 3,860,500; 3,859,092; W. E. Hatfield and R. W. Khynun, *Transition Metal Chemistry*, R. L. Carlin, Ed. Vol. 5, pg. 47 (1969); platinum coordination compounds described in the Encyclopedia of Chemical Technology, Interscience Encyclopedia, Inc., N.Y., Vol. 10, pg, 855 (1953); rhodium compounds described in Coordination Chemistry Revue, 8, 149 (1972); gold compounds described in U.S. Pat. No. 3,661,959, U.S. Pat. No. 3,792,165, *J. Chem. Soc.* 1828 (1937), 1235 (1940), *Australian J. Chem.* 19, 547 (1966) and tellurium (II) coordination complexes such as $Te(S_2COR)_2$, $Te(S_2CNR_2)_2$ described in commonly assigned patent applications Ser. No. 703,405 filed July 8, 1976 by Gysling and Ser. No. 703,477 filed July 8, 1976 by Lelental et al.

When a catalyst precursor is used in forming the marking particle it may be necessary to add a reducing agent for the precursor to the marking particle formulation in order to reduce the precursor to the catalyst. Alternatively, the catalyst precursor may be radiation sensitive. Upon exposure to activating radiation, such precursors convert to the catalytic form. Radiation sensitive catalyst precursors may be particularly useful in certain electrophoretic migration imaging applications. In a preferred embodiment however, the catalyst precursor is reduced to the catalyst in situ by the reducing agent in the physical development composition. In other words the reducing agent in the physical developer composition when brought into contact with the catalyst precursor, first reduces the precursor to the catalyst. The catalyst then acts on this same reducing agent to catalyze the reduction of the oxidizing agent in the physical developer composition.

In general, the electrographic marking particles of the present invention include carbon and resins or polymers. When resins or polymers are used with a liquid carrier, they are preferably insoluble in the liquid carrier or only slightly soluble therein. If the resinous binder has suitable optical density or if no optical density is desired in the image to be developed, the resulting marking particles may be used without any colorant material such as a dye or pigment. In many cases, however, it is desirable for the marking particle to include a colorant material.

Suitable resinous materials used to form marking particles include resins, including natural resins, hydrogenated resins and esters of hydrogenated resins; alkyl methacrylate copolymers having from 2 to 5 carbon atoms in each alkyl moiety, such as isobutyl methacrylate and normal butyl methacrylate copolymers, etc; phenolic resins including modified phenolic resins such as phenol formaldehyde resins; ester gum resins; vegetable oil polyamides; alkyd resins, including modified alkyds such as soya oil-modified and linseed oil modified alkyds, phthalic, maleic and styrenated alkyds, etc; and the like. Other useful resinous materials include polymerized blends of certain soluble monomers, polar monomers, and, if desired, insoluble monomers as described in Belgian Pat. No. 784,367 dated June 30, 1972. Other patents describing suitable resins, methods for forming marking materials and liquid development compositions include for an example: U.S. Pat. No. 3,779,924 issued to Chechak dated Dec. 18, 1973; U.S. Pat. No. 3,788,995 issued to Stahly et al., dated Jan. 29, 1974; and U.S. Pat. No. 3,770,638 issued to Chechak dated Nov. 6, 1973. Suitable resinous materials are also disclosed in Research Disclosure Vol. 109, Index No. 10938, May 1973.

Suitable colorants for use in liquid developers can be selected from a variety of materials such as dyestuffs or pigments. Virtually any of the compounds mentioned in the Colour Index, Second Edition, 1956, Vols. I and II, may, in principle, be used. Other suitable colorant materials are disclosed, for an example, in Research Disclosure Vol. 109, Index No. 10938, May 1973.

The electrographic liquid developers of the present invention preferably contain a suitable amount of the electrographic toner or marking particles of the present invention admixed in a liquid carrier vehicle.

Conventionally, the liquid carrier vehicle used in liquid developers has a low dielectric constant less than about 3.0 and a resistivity of at least about $10^8$ ohm-centimeters, preferably at least $10^{10}$ ohm-centimeters. Among the various useful liquid carrier vehicles are alkyl-aryl materials such as the xylenes, benzene, alkylated benzenes and other alkylated aromatic hydrocarbons such as are described in U.S. Pat. No. 2,899,335 noted above. Other useful liquid carrier vehicles are various hydrocarbons and halogenated hydrocarbons such as cyclohexane, cyclopentane, n-pentane, n-hexane, carbon tetrachloride, fluorinated lower alkanes such as trichloromonofluorane, trichlorotrifluoroethane, etc., typically having a boiling range of from about 2° C., to about 55° C. Other useful hydrocarbon liquid carrier vehicles are the paraffinic hydrocarbons, for example, the isoparaffinic hydrocarbon liquids having a boiling point in the range of 145° C. to 185° C. (sold under the trademark Isopar by Humble Oil and Refining Co.). Various other petroleum distillates and mixtures thereof may also be used as liquid carrier vehicles. Additional carrier liquids which may be useful in certain situations include polysiloxane oils such as dimethyl polysiloxane, odorless mineral spirits, etc.

Liquid developers comprising the electrographic marking particles according to the invention may be conveniently prepared by first forming a developer concentrate. One such concentrate is described in Robinson, U.S. Pat. No. 3,551,337 issued Dec. 29, 1970. To form a concentrate, a suitable polymer or polymers along with the selected metal or metal compound and reducing agent for said metal compound according to the present invention may be dissolved in a mild solvent and placed in a ball mill. If pigments or colorants are to be added they also may be placed in the mix and the combination is milled for a suitable time. Alternatively, the polymer or resins to be used may be dissolved alone initially, and placed on heated compounding rolls which are useful to stir or otherwise blend a resin-containing mixture to promote the complete intermixing of the various ingredients. After thorough blending on such compounding rolls, the mixture is cooled and solidified. The resultant solid mass may then be broken into small pieces and finely ground or milled to form a free flowing powder of finely-divided oleophilic resinous marking particles. Often, milling is done in the presence of a final carrier liquid or a liquid mutually soluble in it in order that resin, colorant (if utilized) and carrier may become thoroughly mixed. After milling is completed the developer concentrate thus formed may be kept for substantial periods. A working developer may be quickly prepared from the concentrate by diluting it to working strength by thoroughly blending it with a suitable electrically insulating carrier liquid.

The amount of catalyst or catalyst precursor in the marking particles of the present invention is about 1 part per million to about $9.99\times10^5$ parts per million. The amount of catalyst or catalyst precursor in the final electrographic liquid developer composition is about $10^{-6}$ g/liter to about $5\times10^2$ g/liter. The resultant developer is in the form of a carrier liquid having admixed therein the finely-divided marking particles. If charge control agents, etc. are utilized, such agents may also be blended with the liquid carrier and finely-divided marking particles during the milling operation described above.

Advantageously, the size of the finely-divided marking particles used in the liquid developer may vary within the range of about 0.05 micron to about 20 microns, preferably within the range of from about 0.1 micron to about 2.0 microns.

Electrographic liquid developer compositions may be formed without the use of resinous materials. Such compositions are useful in electrographic imaging and development methods which employ liquid mist developer compositions. Compositions of this type may be formed simply by dissolving a suitable amount of catalyst or catalyst precursor in liquid medium of the type described above for use in electrographic developer compositions containing resinous marking particles. When in use this composition is atomized to form a liquid mist consisting of liquid droplets each containing a catalyst or catalyst precursor according to the invention. The concentration of catalyst or catalyst precursor added to the liquid medium ranges from $10^{-6}$ g/liter to about $5\times10^2$ g/liter.

As stated hereinbefore, the electrographic developing compositions of the present invention may also include dry carrier materials instead of liquid carrier materials. Such developers may comprise electrostatically responsive toner particles and a particulate carrier, for example, non-magnetic particles such as glass beads, crystals of inorganic salts such as sodium or potassium chloride, hard resin particles, metal particles, etc. In addition, magnetic carrier particles may be used such as steel, iron, cobalt, nickel and alloys and mixtures thereof.

The size of carrier particles used in electrostatic dry developers may vary from about 1.0 to about 30.0 microns although particles outside this range may also be used for particular development conditions or developer compositions. Various types of suitable carrier particles are described in greater detail in Walkup, U.S. Pat. No. 2,618,551, issued Nov. 18, 1952; Wise, U.S. Pat. No. 2,618,552, issued Nov. 18, 1952; Greig, U.S. Pat. No. 2,874,063, issued Feb. 17, 1959; and Maho, Canadian Pat. No. 838,061, issued Mar. 31, 1970. Methods of making and using dry developer compositions are described for an example in Research Disclosure Volume 109, Index No. 10938 published May 1973, which is expressly incorporated herein by reference.

Other examples of developer compositions having dry carriers include aerosol or powder-cloud developers where the carrier comprises a gaseous medium such as air; cascade developers where the carrier typically is a particulate ferromagnetic material; fur brush developers where the carrier typically comprises a rotating brush; etc.

Magnetic brush developers and techniques are described in the following U.S. patents: C. J. Young, U.S. Pat. No. 2,786,439, issued Mar. 26, 1957; E. C. Giaimo, Jr., U.S. Pat. No. 2,786,440, issued Mar. 26, 1957; C. J. Young, U.S. Pat. No. 2,786,441, issued Mar. 26, 1957; H. G. Greig, U.S. Pat. No. 2,811,465, issued Oct. 29, 1957; H. G. Greig, U.S. Pat. No. 2,874,063, issued Feb. 17, 1959; E. C. Giaimo, Jr., U.S. Pat. No. 2,894,163, issued May 16, 1961; W. H. Bliss, U.S. Pat. No. 3,040,704, issued June 26, 1962; H. G. Greig, U.S. Pat. No. 3,117,884, issued Jan. 14, 1964; E. C. Giaimo, Jr. U.S. Pat. No. Re. 25,779, issued May 18, 1965. Other dry developers such as cascade developers have been described in a number of U.S. and foreign patents, such as U.S. Patents: Carlson, U.S. Pat. No. 2,297,691, issued Oct. 6, 1942; Carlson, U.S. Pat. No. 2,551,582, issued May 8, 1951; L. E. Walkup, U.S. Pat. No. 2,618,551.

A typical electrophoretic migration imaging process has been described hereinbefore as background for the present invention. A description of such processes including methods of making dispersions or developers useful therein, may be found in U.S. Pat. No. 2,758,939 by Sugarman issued Aug. 14, 1956; U.S. Pat. Nos. 2,940,847, 3,100,426, 3,140,175 and 3,143,508, all by Kaprelian; U.S. Pat. Nos. 3,384,565, 3,384,488 and 3,615,558, all by Tulagin et al.; U.S. Pat. No. 3,384,566 by Clark; and U.S. Pat. No. 3,383,993 by Yeh. Another type of electrophoretic migration imaging process which advantageously provides for image reversal is described in Groner, U.S. Pat. No. 3,976,485.

Regardless of the particular electrophoretic migration imaging process employed, an essential component of any such process is the electrically photosensitive particles. Electrically photosensitive material containing catalysts or catalyst precursors according to the present invention is useful in any electrophoretic migration imaging process. In general, such electrically photosensitive particles have an average particle size within the range of from about 0.01 micron to about 20 microns, preferably from about 0.01 to about 5 microns. Typically, these particles are composed of one or more colorant materials well known in the art. Such electrically photosensitive particles may also contain various nonphotosensitive materials such as electrically insulating polymers, charge control agents, various organic and inorganic fillers, as well as various additional dyes or pigment materials to change or enhance various colorant and physical properties of the electrically photosensitive particle. In addition, such electrically photosensitive particles may contain other photosensitive materials such as various sensitizing dyes and/or chemical sensitizers to alter or enhance their response characteristics to activating radiation.

When the electrically photosensitive particles containing a catalyst or catalyst precursor according to the present invention are dispersed in an electrically insulating carrier material, such carrier material may assume a variety of physical forms and may be selected from a variety of different materials. For example, the carrier material may be a matrix of an electrically insulating, normally solid polymeric material capable of being softened or liquified upon application of heat, solvent, and/or pressure so that the electrically photosensitive particulate material dispersed therein can migrate through the matrix. In another, more typical embodiment of the invention, the carrier material can comprise an electrically insulating liquid such as decane, paraffin, Sohio Odorless Solvent 3440 (a kerosene fraction marketed by the Standard Oil Company, Ohio), various isoparaffinic hydrocarbon liquids such as those sold under the trademark Isopar by Exxon Corporation and having a boiling point in the range of 145° C. to 186° C., various halogenated hydrocarbons such as carbon tetrachloride, trichloromonofluoromethane, and the like, various alkylated aromatic hydrocarbon liquids such as the alkylated benzenes, for example, xylenes, and other alkylated aromatic hydrocarbons such as are described in U.S. Pat. No. 2,899,335. An example of one such useful alkylated aromatic hydrocarbon liquid which is commercially available is Solvesso 100 made by Exxon Corp. Solvesso 100 has a boiling point in the range of about 157° C. to about 177° C. and is composed of 9 percent xylene, 16 percent of other monoalkyl benzenes, 34 percent dialkyl benzenes, 37 percent trialkyl benzenes, and 4 percent aliphatics. Typically, whether solid or liquid at normal room temperatures, i.e., about 22° C., the electrically insulating carrier material used in the present invention is a material having a resistivity greater than about $10^9$ ohm-cms, preferably greater than about $10^{12}$ ohm-cm. When the electrically photosensitive particles containing catalyst sites according to the present invention are incorporated in a carrier material, such as one of the above-described electrically insulating liquids, various other addenda may also be incorporated in the resultant imaging suspension as indicated hereinabove. Electrically photosensitive particles containing catalysts or catalyst precursors according to the present invention and dispersions or electrographic development compositions containing such particles may be formed according to any of the methods described in the aforementioned patents relating to electrography or migration imaging by simply combining a solution of the catalyst or catalyst precursor with a ball milled dispersion concentrate containing the electrically photosensitive material. For an example a concentrate containing pigment and binder polymer in Solvesso 100 (Exxon Corp.) may be combined with type 440, ⅛ inch diameter stainless steel balls. The entire mixture is transferred to a closed container and ball milled until the desired particle size is obtained. An aliquot of the concentrate, about 5 ml, may then be diluted with a material such as Piccotex 100 (Penn. Ind. Chem. Corp.) in Isopar G. The diluted aliquot is then mixed thoroughly. At this time, the catalyst or catalyst precursor may be added.

Apparatus useful in carrying out electrophoretic migration imaging processes are well known. Typical apparatus is described in the aforementioned patents.

In general, any high gain chemical redox amplification method will be useful in the present invention. As is well known, such methods involve image formation through catalyzed oxidation-reduction reactions. For an example, an aromatic primary amine color developing agent may be catalytically oxidized by an oxidizing agent in an imagewise fashion and the oxidized color-developing agent may then be reacted with a photographic color coupler to form a dye image. Physical development methods are also an example of oxidation-reduction amplification methods which are useful in the present invention. Other high gain chemical redox amplification methods include imagewise production of catalyst for the decomposition of peroxy compounds in the presence of reaction components for a color forming oxidizing reaction as disclosed in aforementioned U.S. Pat. No. 3,674,490; use of a transition metal-ion complex to amplify a prerecorded image as disclosed in U.S. Pat. No. 3,834,907 by Travis; conducting an imagewise oxidation reaction on a catalytic surface whereby an image is formed by chemically combining one of the reaction products with a reactive species to produce a change in light value as disclosed in U.S. Pat. No. 3,862,842 by Bissonette, issued Jan. 28, 1975; and imagewise exposure to form catalysts for the decomposition of hydrogen peroxide followed by treatment with a periodic compound to form a visible image as disclosed in U.S. Pat. No. 3.765,890 to Weyde et al, issued Oct. 16,1973 and autocatalytic imagewise reduction of Co(III) complex to Co(II) chelation in the presence of Co(II) catalyst as disclosed in *Research Disclosure,* Item 13505, Volume 135, July 1975. While the utility of the present invention in amplifying developed image patterns will be described herein in connection with physical developement methods, it will be readily understood by those skilled in the art that any high gain chemical redox amplification method such as, for example, those described above will be useful in the present invention.

The principles relating to physical development in the photographic field are well known. General discussion of the principles involved in the formulation of physical developers and their use in amplifying photographic latent images can be found in patents and other literature. For an example, a series of articles appearing in Volume 13 of the Photographic Science and Engineering Journal, from January through April of 1969, by Jonker et al.; British Pat. No. 1,340,789 to Miller et al., published Dec. 12, 1973; U.S. Pat. No. 3,860,501 to Gysling, dated Jan. 4, 1970. It is therefore unnecessary to discuss such principles in detail herein.

With regard to the present invention it is sufficient to state that marking particles of the present invention are contacted with a physical developer composition comprising (a) an oxidizing agent in the form of, for example, a metal compound, a mixture of metal compounds, a dye, a dye precursor or the like and (b) a reducing agent for the oxidizing agent. The catalyst causes the reduction of the oxidizing agent resulting in the deposition of the oxidizing agent upon the developed charge pattern, particularly in the vicinity of the catalytic sites.

When the catalyst in the developed image is in the form of a catalyst precursor, it is necessary to reduce the precursor to its catalyst form. In accordance with the present invention, this reduction may be carried out by the reducing agent in the physical developer composition. The reducing agent in the physical developer composition first reduces the catalyst precursor to the corresponding catalyst state, such as, for example, a free metal. The thus formed catalyst then catalyzes reduction of the oxidizing agent by the remaining portion of said reducing agent causing deposition of reduced oxidizing agent on the developed charge pattern in the vicinity of the catalytic sites.

The deposition of reduced oxidizing agent on the developed image pattern results in the amplification of said image pattern. This amplification is evidenced by the increased maximum density of said image. Thus the present invention is capable of increasing maximum density or increasing speed or both. The present invention now makes it possible to carry out electrographic imaging processes at lower levels of exposure.

As previously stated herein, the physical developer compositions useful in the present invention comprise an oxidizing agent which may be a metal compound, a mixture of metal compounds, a dye, a dye precursor, or the like; and a reducing agent for the oxidizing agent. The composition is formulated so that the reducing agent is not effective in the absence of an appropriate catalyst. The physical developer composition may be in the form of a liquid solution or in the form of an element which comprises a physical developement composition coated on a support.

In general, the physical developer compositions of this invention can be prepared merely by mixing the various components. The components can be mixed in a dry state and then water can be added when the developer solution is desired for use. Alternatively, because of the stability of these developer solutions, the various components can be added to water prior to the time the developer solution is to be used. The order in which the components are added is not considered to be critical.

As stated hereinbefore, physical developer compositions typically contain an oxidizing agent in the form of a metal compound, a mixture of metal compounds, a dye or a dye precursor and a reducing agent for said oxidizing agent. In addition, it will be understood that such physical developer compositions may also contain other addenda generally added to such physical developer compositions in the photographic arts including a complexing agent and a variety of other materials to facilitate maintenance and operation of the developer and to improve the quality of the developed image, such as binders, stabilizing agents, surfactants, antifoggants, buffers, thickening agents, brightening agents and the like.

A physical developer bath comprising a leucophthalocyanine dye and a reducing agent therefor would be useful in the present invention. The reduction of the leucophthalocyanine dye to phthalocyanine can be catalyzed by palladium metal. The leucophthalocyanine dye and the reducing agent therefor may be a liquid. Alternatively, the dye and reducing agent may be included in a coating composition. The coating composition may be coated on a suitable support and when ready for use is contacted to the developed image pattern containing for an example, palladium catalyst at a temperature of from 45° C. to 250° C. It is thought that the palladium diffuses into the coated leucophthalocyanine-reducing agent composition coated on the support thus resulting in the reduction of the leucophthalocyanine dye to phthalocyanine and formation of a dye image. Methods of making physical developer compositions, both liquid bath and element comprising coated compositions of the type just described, are disclosed in detail in Research Disclosure Volume 142, Index No. 14229, February, 1976 which is expressly incorporated herein by reference.

A physical developer composition comprising a tetrazolium salt and a reducing agent therefor is also useful in the present invention. When this composition is contacted with an element from Groups VIII and/or IB of the Periodic Table, the tetrazolium salt is reduced by the reducing agent to its formazan dye counterpart and formazan deposits in the vicinity of the element forming a dye image. This physical developer composition may be in the form of a liquid bath or an element. The element comprises a coating containing the salt and reducing agent and a polymeric binder coated on a support. The liquid bath and the element may be used in the manner previoously described for the liquid bath and element of leucophthalocyanine dye and reducing agent.

Tetrazolium salts useful in such physical development compositions include tetrazolium slats, di-tetrazolium salts and tetrazolium betaines. Useful tetrazolium salts are described in "The Chemistry of Formazans and Tetrazolium Salts", A. W. Ninham, Chemical Review, 55,355 (1955).

Physical developer baths of this type, can be made from substantially equal volumes of a solution of a tetrazolium salt in a solution of a reducing agent. The physical developer bath is considered useful if the tetrazolium salt is not spontaneously reduced to formazan dye but is spontaneously reduced to formazan dye when palladium metal is added to the bath. By spontaneously, it is meant that the formazan dyes form essentially instantaneously in the presence of catalyst. It should be understood that the physical developer will be useful if it is stable for a time long enough to process the element. Typically, however, physical developer baths of this type are stable for several months.

Methods of making and using physical developer compositions comprising tetrazolium salts and a reducing agent are described in Research Disclosure, Volume 142, Index No. 14230, February, 1976, page 34, which is expressly incorporated herein by reference.

Another physical developer element useful in the present invention comprises an oxidation-reduction image forming combination comprising (1) a tellurium complex as an oxidizing agent, expecially a tellurium complex which is a coordination complex of tellurium II, (2) a reducing agent and (3) a binder coated on a support. When this physical developer element is contacted with a developed image pattern having metal nuclei such as cobalt, nickel, copper, palladium, silver, rhodium, tellurium and gold, in the presence of heat the tellurium complex decomposes in the vicintiy of the aforementioned nuclei resulting in an amplification of the developed charged pattern.

Especially useful tellurium complexes are tellurium complexes which are coordination complexes of tellurium (II), typically coordination complexes of tellurium (II) with two univalent bidentate sulfur-containing ligands. The described complexes of tellurium II have a coordination number of four. The complexes are characterized by having at least one of the coordination ligands coordinate to the tellurium through a sulfur atom. However, complexes as described may have any number of tellurium II coordination positions occupied by the sulfur atom of a suitable sulfur-containing ligand.

A variety of reducing agents are useful in physical development compositions comprising tellurium complexes. Such reducing agents can be organic or inorganic. Reducing agents which are especially useful are typically silver halide developing agents described hereinbefore. Other reducing agents are described in *Research Disclosure,* Vol. No. 105, Item No. 10513, January 1973, pages 16–21. The physical development compositions comprising tellurium complexes and a reducing agent therefor, can be coated on a suitable support by various coating procedures known in the photographic art including dip coating, air knife coating, curtain coating or extrusion coating. Such techniques are well-known in the patent literature. Supports upon which the compositions can be coated can be chosen from a variety of materials so long as such materials can tolerate the process temperatures employed. Typical supports include cellulose ester film, poly(vinyl acetal) film, poly(ethyleneterephthalate) film, polycarbonate film, and polyester films Image intensification with tellurium physical development compositions can be effected within a short time merely by overall heating of the heat developer element. For example, the heat developer element can be heated to a temperature within the range of about 80° C. to about 220° C. until a desired image is developed, typically within about 1 to about 90 seconds.

Other physical developer elements comprising various tellurium complexes and various reducing agents including methods of making and using same, are disclosed in our copending U.S. patent application Ser. No. 703,477 by Lelental and Gysling, filed July 8, 1976, which is expressly incorporated herein by reference.

Useful physical developer solutions containing a metal salt typically contain an aqueous solution of salts of reducible metals such as nickel, copper, cobalt, tin, platinum, lead, gold, mercury, palladium or silver. The physical developer solution employed may be any developer previously employed in the physical development of conventional photographic images. For example, a developer solution containing at least $5\times10^{-3}$ mole per liter of a reducible metal salt such as a silver salt may be employed. This solution may also contain one or more reducing agents known in the photographic art. The reducible metal ions may be any of those which may be reduced to the metal by any of the well known photographic developing agents. In conventional physical developer solutions, the reducible metal salt is a water soluble silver salt usually silver nitrate. However, other soluble silver salts may be used as well as salts of metals such as copper, nickel, cobalt, mercury, platinum, gold, palladium, etc.

The physical developer solution generally contains a reducing developer along with the metal salts such as $NaH_2PO_2.H_2O$, amine borane, formaldehyde, p-methylaminophenol sulfate and the like, a polyhydroxy benzene developer or the like. Typical useful silver developers include hydroquinone, catechol, ascorbic acid, isoascorbic acid, pyrocatechol, gallic acid, gentisic acid, pyrogallol etc. p-Phenylenediamine type silver halide developers may also be used. In addition, aminophenol types may be used such as p-methylaminophenol sulfate, o-aminophenol, p-hydroxyphenolglycine etc.

Other physical developer compositions which utilize metal catalyst are described for an example in U.S. Pat. No. 3,647,439 to Bass, issued Mar. 7, 1972; U.S. Pat. No. 2,868,643 to Dejonge et al., issued Jan. 13, 1959; U.S. Pat. No. 3,130,520 to Dipple et al., issued Apr. 21, 1964; U.S. Pat. No. 3,223,525 to Jonker et al., issued Dec. 14, 1965; and U.S. Pat. No. 3,650,748 to Yudelson et al., issued Mar. 21, 1972.

The following examples are presented to provide a greater understanding of the broad utility of the present invention. Examples 1–12 demonstrate the invention's utility in electrophotographic proceess, Examples 13–14 demonstrate the invention's utility in electrophoretic migration imaging processes and Examples 15–19 demonstrate the inventions's utility in electrostatic printing processes.

EXAMPLES 1-12:

Electrophotgraphic processes in which the present invention is useful employ an electrophotographic or photoconductive element typically comprising a coating of a photoconductive insulating material on a conductive support. The element is given a uniform surface charge in the dark and then is exposed to an image pattern of activating electromagnetic radiation such as light or X-rays. The charge on the photoconductive element is dissipated in the illuminated area to form an electrostatic charge pattern which is then developed by contact with an electrographic marking material of the present invention. The marking material or toner, as it is also called, whether carried in an insulating liquid or in the form of a dry powder, deposits on the exposed surface in accordance with either the charge pattern or the discharge pattern, as desired. The developed image may be transferred to another receiver surface. In any case, whether or not the developed image is transferred to another receiver, the developed image is defined by the marking particles of the present invention which include catalyst or catalyst precursors according to the present invention. In accordance with the present invention, the developed image is amplified by contacting it with a physical developer as described hereinabove.

EXAMPLE 1

The surface of an organic photoconductor layer coated on a poly(ethylene terephthalate) support containing a CuI conducting layer and a strippable overcoat was corona charged to −700 volts in the dark, exposed to a projected line copy image and developed in a liquid developer composition comprising Pd(O) doped electrographic marking particles.

A liquid electrographic developer (no Pd dopant) was made by adding the total solution (A) listed below to 1 liter of Isopar G (Humble Oil Company) under ultrasonic agitation.

| Solution A | |
|---|---|
| Poly(ethyl acrylate-co-ethyl methacrylate-co-lauryl methacrylate/lithium sulfoethyl methacrylate) | 0.175 g |
| Poly(vinyl toluene-co-lauryl methacrylate-co-lithium methacrylate-co-methacrylic acid) | 0.35 g |
| Solvesso 100 (Humble Oil Co.) | 5.57 g |

The size of the polymeric marking particles was about 0.3 microns as measured from electron micrographs.

Pd(O) doping of the polymeric marking particles was accomplished by adding 5 ml of a tetrahydrofuran (THF) solution of $Na_2PdCl_4$ (100 mg $Na_2PdCl_4$/100 ml THF) to 100 ml of the electrographic developer and subsequently reducing the Pd(II) to Pd(O) with 5 ml of a THF solution of dimethylamine borane (DMAB) (100 mg DMAB/100 ml THF). Electron micrographs revealed numerous small Pd nuclei attached to the marking particles.

The electrophoretically developed layer was subsequently immersed for 3 minutes in a tetrazolium salt dye physical developer bath of the following composition:

2,3,5 Triphenyl-2H-tetrazolium chloride (TPTC)—2.5 g/100 ml $H_2O$

Dimethylamine borane (DMAB)—1.0 g/100 ml $H_2O$

NaOH to pH 13.0

A good quality magenta formazan dye image resulted. The formazan dye was formed in the area where Pd(O) doped marking particles were deposited, which corresponded to the dark parts of the original projected image. The highly coloured photoconductor layer containing the magneta image was then brought into face-to-face contact with another poly(ethylene terephthalate) support bearing a clear thermoplastic coating. Under heat and pressure (30 psi, 130° C.) the strippable overcoat with the magenta image was transferred to the clear layer forming a high quality image with a clear background and a protective overcoat.

The amplification factor for the TPTC (2,3,5-Triphenyl-2H-tetrazolium chloride)-DMAB(dimethylamine-borane)-Pd nuclei system is estimated to be $10^6$ to $10^7$ (dye molecules per one Pd atom), depending on Pd coverage. This value was determined using electron micrographs of formazan dye crystals formed by the palladium catalyzed reduction of TPTC. The average measured crystallite (volume) of formazan dye formed on 2-3 atoms Pd centers is estimated to be $0.004\mu^3$. Assuming that the density of triphenyl formazan is close to 1.3 g/cm$^3$, one can estimate that crystallites of this size correspond to approximately $1.0\times10^7$ molecules of dye.

EXAMPLE 2

The electrographic developer composition of Example 1 was used to develop electrostatic images formed on two different insulator receiver layers by a simultaneous charge and exposure electrographic process. A nickel physical developer of the following composition was used to amplify the developed image:

| | | |
|---|---|---|
| (A) | Stock Solution | |
| | $NiCl_2$ $6H_2O$ | 0.1 M |
| | Gluconic Acid | 0.65 M |
| | NaOH | pH 5.0 |
| | $NH_4OH$ | pH 9.0 |
| | $NaH_2PO_2$ | 0.2 M |
| (B) | 100 ml of the above solution was added to 50 ml of an aqueous solution containing 0.15 g monomethylhydrazine bisborane (MMHBB) to yield stock solution containing 0.1% by weight MMHBB. | |

The process employed in forming the electrostatic images was as follows: an organic photoconductor was brought into face-to-face contact with an insulator layer. A 1.5 kV potential was applied across the two layers simultaneous with imagewise light exposure of the photoconductor. After separation, the insulator sheet was developed in the electrographic developer of Example 1, dried and subsequently amplified in the nickel physical developer described above.

The photoconductor layer was 20 microns thick and was coated over a nickel conducting layer that had been vacuum evaporated on a poly(ethylene terephthalate) support. One of the two insulator receivers was a 125 micron thick Mylar thermoadhesive tape (4T300003-040 G.T. Schjeldahl Co.) heat-laminated to a conducting film support. The other receiver was a 10 micron thick layer insulator layer containing $TiO_2$ particles coated on a conductive paper stock. The resulting negative-to-positive images were of good quality.

EXAMPLE 3

Another nickel image was produced by the process described in Example 2. Copper was plated over the nickel by immersing the nickel image for 30 min. in a copper electroless plating bath (Sel-Rex Oxytron Lectroless Cu No. 990).

EXAMPLE 4

An image having good maximum density was produced by the same process described in Example 2 except that a 0.6 mm. polyester film was used as the receiving layer and copper was plated over nickel as in Example 3. The 0.6 mm. polyester film was sandblasted on the surface facing the photoconductor to produce a more uniform air gap and, hence, a better quality image. A conducting layer of cermet (Cr, SIO) was sublimed on the opposite side of the receiver. A voltage of 4 kV was applied across the 20 micron photoconductor, air gap and the polyester film during the exposure. The image was of good quality.

EXAMPLE 5

An electrostatic image was formed on a 1 mm. thick polyester film layer in the manner described in Example 2. However, a different method and photoconductor were employed. Instead of bringing the photoconductor and insulator layer in face-to-face contact over a large area, the insulator receiver layer was wrapped around a 10 cm. diameter idler roller and the flat photoconductor held on a transparent vacuum platen was translated in pressure contact with the insulator. The 1 mm. thick photoconductor coating consisted of PbO pigment dispersed in a "PLIOLITE S-5" (Goodyear Tire and Rubber) binder. Prior to imaging, the insulator surface was discharged and then precharged to about +500 volts. The original to be copied was in contact with the support side of the photoconductor. To make the electrostatic latent image, a voltage of 2.5 kV was applied between the metal idler roller and the conductive layer of the photoconductor. Simultaneous with this voltage a light intensity of 1 kfc impinged on the nip formed between the insulator receiver and photoconductor after being modulated with a test target taped to the backside of the vacuum platen. The translational speed of the photoconductor was 22.5 cm/sec. The polarity of the voltage was negative on the photoconductor. After developing and heating at 130° C. for 1 min., the insulator layer was placed in a copper plating solution as described in Example 3. Upon heating again at 130° C. for 30 minutes the electrical resistance of the copper image and the degree of adhesion to the insulator support was tested. The adhesion was very good and the surface resistance between two probes held about 2 mm apart was 15 ohms.

Another copper print was made in a similar manner except that the insulator support consisted of 1 mm. polyester film without a conducting layer. One side of the support was subbed, however, and placed next to the metal idler roller for imaging. The image was of comparable quality to the one containing the uniform conducting layer.

EXAMPLE 6

An insulating, dry tellurium physical development (TPD) element was prepared by coating the following solution on cermet (Cr, SiO) coated polyester film 2 mm. wet thickness.

(A) 100 mg $Te[S_2CN(C_2H_5)_2]_2$ dissolved in 7.5 ml of a 2% acetone:toluene (1:1) solution of Monsanto Butvar® B-76 [(poly(vinylbutyral) resin]

(B) Add 1.5 ml. of a 10% solution of 2-hydroxy-5-methyl-3-piperidino-2-cyclopentenone (DAPHR) in acetone-toluene (1:1).

The dried coating was corona charged imagewise through a stencil to −500 volts. This element was electrophoretically developed according to Example 1. The dry TPD layer was then heated at 150° C. for 10 sec. A fair quality print of black characters resulted.

EXAMPLE 7

Two pieces of 125 micron thick polyester film were corona charged through a metal stencil forming a latent image of the charge pattern. One piece was negatively charged and the other positively charged. Both were developed as described in Example 1. The catalyst sites were amplified by heat developing in face-to-face contact with a TPD layer coated on paper support. The TPD layer had the composition given in Example 6. Each pair of layers were heat processed by passing them through a pair of heated rollers (160° C., 0.5 cm/sec). High density was seen in the regions of negative charge for the one film and low density in the region of positive charge for the other film.

EXAMPLE 8

Gold Doped Electrographic Developer

The stock solution of a liquid electrographic developer containing gold doped electrographic marking particles was made by adding the total solution listed below to 900 ml of Isopar G under ultrasonic agitation.

| | |
|---|---|
| Poly(ethyl acrylate-co-ethyl methacrylate-co-lauryl methacrylate-co-lithium sulfoethyl methacrylate) | 0.175 g |
| Poly(vinyl toluene-co-lauryl methacrylate-co-lithium methacrylate-co-methacrylic acid) | 0.35 g |
| Solvesso 100 (Humble Oil Co.) | 5.57 g |
| $NaAuCl_4 \cdot 2H_2O$ in 100 ml of tetrahydrofuran | 100 mg |

The surface of an organic photoconductor layer coated on polyethylene terephthalate support containing a CuI conducting layer was corona charged to −500 volts in the dark. The exposure was made by contacting the photoconductor's surface with a silver original comprising dark letters on a clear background and illuminating with room lights (50 fc) for 1 min. through the original. The electrostatic latent image was developed by dipping the photoconductor into the colorless electrographic developer described above. A portion of the developed electrostatic latent image was amplified by laminating it face-to-face with a dry formazan dye physical development element (FDPD) and heat processing for 5 seconds at 130° C. A good quality positive magenta image was formed.

The FDPD element was prepared by coating the following solution on poly(ethylene terephthalate) subbed with poly(methylacrylate)-co-vinylidene chloride-co-itaconic acid (0.5 mm. wet thickness, 50° C.) and drying for 5 min. at 55° C.

2,3,5-Triphenyl-2H-tetrazolium chloride—450 mg
Dimethylamine borane (DMAB)—75 mg
Poly(vinyl pyrrolidone) (GAF)—375 mg
Dissolved in 7.5 ml of 7:3:1 dichloromethane:1,1,2-trichloroethane:isopropyl alcohol solvent mixture.

Another portion of the developed electrostatic latent image was amplified by laminating it face-to-face with a dry tellurium physical development (TPD) element and heat processing for 5 seconds at 150° C. A good quality black positive, image resulted. The TPD element was prepared by coating the following solution on a resin coated paper support 1 mm. wet thickness, 35° C.) and drying for 5 min. at 55° C.

Tellurium bis(isopropylxanthate)—40 mg
1-phenyl-3-pyrazolidone—100 mg
Butvar ® - B76—500 mg All dissolved in 10 ml of 7:3:1 dichloromethane:1,1,2-trichloroethane:DMF solvent mixture.

EXAMPLE 9

Silver Doped Electrographic Developer

An electrostatic latent image was produced and developed by the process described in Example 8. The development was carried out using a developer containing silver doped marking particles prepared as described in Example 8 using 100 mg of silver trifluoroacetate ($AgCF_3COO$) instead of 100 mg of sodium tetrachloroaurate ($NaAuCl_4.2H_2O$). The developed electrostatic latent image was amplified by laminating it with the TPD element described in Example 8 and heat processing for 5 seconds at 150° C. A good quality black positive image resulted.

EXAMPLE 10

Copper Doped Electrographic Developer

An electrostatic latent image was produced and developed by the process described in Example 8. The electrophoretic development was carried out using an electrographic developer containing copper doped electrographic marking particles prepared as described in Example 8 using 100 mg of copper octanate ($Cu(C_7H_{15}COO)_2$) instead of sodium tetrachloroaurate. The developed image was amplified by laminating it with the TFD element described in Example 8 and heat processing for 5 seconds at 150° C. A good quality black positive image was formed.

EXAMPLE 11

Rhodium Doped Electrographic Developer

An electrostatic latent image was produced and developed by the process described in Example 8. The development was carried out using an electrographic developer containing rhodium doped electrographic marking particles prepared as described in Example 8 using 100 mg of rhodium chloride ($RhCl_3$) instead of sodium tetrachloroaurate.

A portion of the developed i.e. toned, image was amplified by laminating it with FDPD-formazan dry physical development element described in Example 8 and heat processing for 5 seconds at 130° C. A good quality magenta image was formed.

Another portion of the developed image was amplified by laminating it with TPD element described in Example 8 and heat processing for 5 seconds at 150° C. A good quality black imasge was formed.

An additional portion of the developed i.e. toned, image was amplified by solution nickel physical development process using nickel physical developer of the following composition:

$NiCl_2.6H_2O$—50 g/l
$Na_2P_2O_7.10H_2O$—75 g/l
$NH_4OH$ to pH 10.5
Monomethylhydrazine bisborane (MMHBB—1 g/l (plus water to make 1 liter)

A good quality black positive image resulted.

EXAMPLE 12

Electrographic Developer Doped with Homogeneous CO(II) Catalyst

An electrostatic latent image was produced and developed by the process described in Example 8. The development was carried out using cobalt (II) doped electrographic marking particles prepared as described in Example 8 using 100 mg of $CoCl_2.6H_2O$ instead of 100 mg of sodium tetrachloroaurate. The developed image was amplified by laminating it with a development element containing cobalt (II) tris(ethylenediamine)trifluoroacetate and 4-(2-pyridylazo) resorcinol as described in *Reserach Disclosure,* Volume 146, Index No. 14614, June 1976 and heat processing for 3 seconds at 120° C.

The following examples illustrate the utility of the present invention in electrophoretic migration imaging systems.

The electrophoretic migration imaging process used to exemplify this invention employed a layer of electrically photosensitive particles containing a catalyst or catalyst precursor according to the present invention and a carrier positioned between two spaced electrodes, one of which was transparent. The particles positioned between the two spaced electrodes, as described above, are subjected to the influence of an electric field and exposed to activating radiation. As a result, the charge-bearing electrically photosensitive particles migrate electrophoretically to the surface of one or the other of the spaced electrodes. The result is an image pattern on the surface of both electrodes. A negative image is formed on one electrode, and a positive image is formed on the opposite electrode.

The apparatus used was similar to that shown in FIG. 6 of U.S. Pat. No. 3,976,485 to Groner issued Dec. 24, 1976. It consisted of a translating NESATRON glass plate electrode (a transparent conductive, indium oxide glass from Pittsburgh Plate Glass) driven from the back side by two resilient rollers. A 10 cm diameter resilient, conductive, idler roller electrode covered with an insulator coated paper made pressure contact with the front surface of the NESATRON glass electrode. The idler roller was positioned midway between the two drive rollers to allow exposure through the NESATRON glass to the photosensitive dispersion contained in the nip. The test target to be reproduced was taped to the back of the NESATRON glass and moved with it. A Kodak Carousel ® projector was used as the light source. For these examples, a slit of white light was projected through the test target to the photosensitive dispersion in the nip.

The operating conditions in forming the images were the same for all examples. A 4 mm wide slit of light having an intensity of about 3 kfc was projected into the nip. One edge of the slit coincided with the idler roller axis and extended into the nip containing the dispersion. The translational speed of the NESATRON plate electrode was 12 cm/sec. A voltage of 1.2 kV was applied between the roller electrode and NESATRON plate. The NESATRON plate was negative with respect to the grounded roller. The test target consisted of clear letters and bands on a high density background. The prints used for further chemical amplification were the negative-to-positive ones formed on the insulator coated paper wrapped around the idler roller electrode.

The specific dispersions and their preparations will be outlined in each example.

EXAMPLE 13

A magenta photosensitive dispersion was prepared by first ball milling a concentrate of the following ingredients:

| | |
|---|---|
| Sandorin Brilliant Red 5BL (Sandoz Corp.) | 3 g |
| Copolymer of vinyl toluene/lauryl methacrylate/lithium methacrylate/methacrylic acid | 3 g |
| Solvesso 100 (Exxon Corp.) | 36.6 g |
| Type 440, ⅛ in diameter stainless steel ball | 330 g |

This concentrate was ball milled in a 125 ml glass jar for one week at 115 revolutions/min. A 5 g aliquot of the above concentrate was placed in a water-cooled stainless steel container and ultrasonically dispersed with a diluent. The diluent was 16.4 ml of a 10 percent, by weight, solution of Piccotex 100 (Penna. Inc. Chem. Corp.) in Isopar G. The diluent was added to the concentrate through a hollow ultrasonic probe immersed in the concentrate. It was added at a rate of 15 ml/min. The coolant water was maintained at 20° C. during the operation.

Part of the above dispersion was doped with a catalyst precursor in the form of a metal salt ($Na_2PdCl_4$) dissolved in tetrahydrofuran (100 mg/100 ml). Fifteen parts of the precursor solution was added to 100 parts of the photosensitive magenta dispersion. The mixture was shaken on a Red Devil paint conditioner for 4 hours.

Photoelectrophoretically developed prints were formed with both the doped and undoped magenta photosensitive dispersions. These prints were further processed by two physical development methods. One method involved heating in the presence of a dry formazan dye physical development (FDPD) sheet as described in Example 8 and the other method involved a dye-forming solution physical development process as described in Example 1.

Parts of the migration image prints formed with either the doped or undoped dispersions were covered with the magenta FDPD sheet. These were laminated together under heat and pressure and then further heat processed at 130° C. for four seconds. No change in net green reflection density [ΔD (after amplification)—ΔD (photoelectrophoretically developed print)] was observed for the undoped control. ΔD is the difference between $D_{max}$ and $D_{min}$. However, a density increase of 0.6 was observed for the catalytically doped print. A MacBeth model RE-100 densitometer outfitted with Status A filters was used to measure the reflection densities.

Unused portions of the above prints were immersed in the TPTC-DMAB magenta dye-forming solution physical developer for one hour. Again, no net density increase was measured for the undoped control sample, but a net green reflection density increase of 0.4 was recorded for the doped migration print.

A summary of the pertinent data is included in the following table:

| Dispersion | Increase in Image Density (green reflection density) Thermal Dev. | Solution Dev. |
|---|---|---|
| Catalytic doped magenta photosensitive dispersion | 0.6 | 0.4 |
| Undoped magenta photosen-dispersion | 0 | 0 |

EXAMPLE 14

A yellow photosensitive dispersion was prepared by first ball milling a concentrate comprising the following materials:

| | |
|---|---|
| 9,9-[2,6-naphthyl-bis-ethylene]-bis-julolidine | 10 g |
| Copolymer of vinyl toluene/lauryl methacrylate/lithium methacrylate/methacrylic acid | 10 g |
| Solvesso 100 | 122 g |
| Type 440 (⅛ inch) stainless steel ball | 200 cc |

This concentrate was allowed to ball mill for about 4 months at a rotational speed of about 60 rev/min. At the end of this time, 430 ml of a 40 percent, by weight, solution of Piccotex 100 in Isopar G was added to the concentrate. The ball milling was continued overnight with the diluent added.

A small amount of this yellow photosensitive dispersion was doped with the same catalyst as Example 1. The method of blending and the proportions were also identical.

Both thermal and solution physical development were performed on the yellow-colored migration prints as outlined in Example 13. Both physical development methods resulted in magenta dye images to dye formed on the yellow pigments. Only the green density increases were measured.

A summary of the net increase in green reflection density is given below:

| Dispersion | Increase in Image Density (green reflection density) Thermal Dry | Solution |
|---|---|---|
| Catalytic doped yellow photosensitive dispersion | 0.3 | 0.6 |
| Undoped yellow photosensitive control | 0 | 0 |

The following examples illustrate the invention's utility in electrographic imaging systems utilizing liquid mist developer compositions such as the electrostatic printing systems disclosed in U.S. Pat. No. 3,779,166 to Pressman et al., issued Dec. 18, 1973. Examples 17, 18 and 19 were carried out using a device substantially similar to the device described in this patent.

EXAMPLE 15

The following two solutions of a catalyst precursor were prepared:

| | |
|---|---|
| Solution A | |
| Acetophenone | 100 ml |
| $Na_2PdCl_4$ | 100 mg |
| Solution B | |
| 1,2-Bis(2-methoxyethoxy)-ethane | 100 ml |

-continued

| | |
|---|---|
| $Na_2PdCl_4$ | 100 mg |

These solutions were stirred for 48 hours and filtered. Each was atomized. The resulting mist was directed to a piece of resin-coated paper for about two seconds for each solution. After drying the condensed mist, a dry formazan dye physical development (FDPD) element as described in Example 8 was laminated to the resin-coated paper. The sandwich configuration was then heated for about five seconds at 120° C. A magenta image formed in the region in which the catalytic mist had condensed. The green reflection density of the exposed portion was about 1.4 in each case.

EXAMPLE 16

Solution A of Example 15 was used to form a stencil image on the resin-coated paper. The atomization was carried as in Example 15 but instead of directing the mist directly onto the paper, it was modulated imagewise by placing a metal stencil next to the paper. The physical development of the invisible catalytic image was done as in Example 15. A good quality magenta image corresponding to the openings of the metal stencil was observed.

EXAMPLE 17

A modulated electrostatic printing device substantially similar to that described in aforementioned U.S. Pat. No. 3,779,166 was used to form a test pattern with Solution A on the resin-coated paper. This invisible image was developed as in Example 15, to form a magenta print.

EXAMPLE 18

Solution A was used in the device of Example 17 to form a magenta print directly on a FDPD layer coated on a paper support.

The FDPD element was prepared by coating the following solution (3 mil wet thickness) on a resin-coated paper support:

| | |
|---|---|
| 2,3,5-Triphenyl-2H-tetrazolium chloride | 450 mg |
| Dimethylamine borane (DMAB) | 450 mg |
| Butvar B-76 dissolved in 10 ml of 7:3:4 dichloromethane:1,1,2-trichloroethane:DMF solvent mixture | 500 mg |

The solution was coated at a temperature of 38° C. and dried for 15 minutes at 55° C.

Both a standard ink mist pattern comprising alphanumeric characters and a "full-on" pattern were deposited on the FDPD paper at about 50 cm/sec. The processing of the invisible imagewise deposit of catalyst precursor was accomplished by heat processing the FDPD paper at 140° C. for 5 seconds.

A reflection microdensitometer equippped with a Kodak Wratten No. 75 filter was used to scan the "full-on" image. The $D_{max}/D_{min}$ values were about 1.5/0.3. The normal $D_{max}$ achieved with the ink mist process using a dissolved dye is in the neighborhood of 0.6

EXAMPLE 19

Solution A was used in the device of Example 17 to form a black print directly on a dry tellurium physical development (TPD) layer coated on paper support. The TPD element was prepared by coating the following solution (1 mm. wet thickness) on resin-coated paper support.

| | |
|---|---|
| Tellurium bisacetophenone dichloride | 100 mg |
| 1-phenyl-3-pyrazolidone | 100 mg |
| Butvar ® B-76 | 500 mg |

dissolved in 10 ml of 7:3 dichloromethane:1,1,2-trichloroethane solvent mixture. The solution was coated at a temperature of 25° C. and dried for 15 minutes at 25° C. The standard ink mist pattern comprising alphanumeric characters was deposited on the TPD paper at about 50 cm/sec. The processing of the invisible imagewise deposit of catalyst precursor was accomplished by heat processing the TPD paper at 90° C. for 20 seconds. A good quality black image was observed.

The invention has been described in detail with particular reference to certain preferred embodiments thereof, but it will be understood that variations and modifications can be effected within the spirit and scope of the invention.

We claim:

1. A method for amplifying a developed charge pattern residing on an insulating receiver comprising the steps of:

(a) contacting a charge pattern with an electrographic developer composition comprising a carrier and marking particles having a polarity opposite that of said charge pattern thereby producing said developed charge pattern; wherein said marking particles contain a resin and a catalyst or catalyst precursor which is a metal or metal compound and said metal is selected from the metals forming groups VIII and IB of the Periodic Table including alloys and mixtures of such metals; and (b) contacting said developed charge pattern with a high gain chemical redox amplification composition.

2. A method according to claim 1 wherein said high gain chemical-redox amplification composition is a physical development composition.

3. A method according to claim 2, wherein said carrier is a liquid and said metal is selected from the group consisting of copper, silver, cobalt, nickel, rhodium, tellurium, palladium and gold, including alloys and mixtures of such metals.

4. A method according to claim 2, wherein said marking particle also comprises a colorant.

5. A method according to claim 2, wherein said carrier is a dry material and said metal is selected from the group consisting of copper, silver, cobalt, nickel, tellurium, rhodium and palladium, including alloys and mixtures of such metals.

6. A method for amplifying a developed electrographic image pattern comprising the steps of:

(a) contacting a charge pattern with an electrographic developer composition comprising marking particles containing a resin and a catalyst or catalyst precursor thereby charging said particles; wherein said catalyst is a metal or metal compound and said metal is selected from the group of metals forming groups VIII and IB of the Periodic Table, including alloys and mixtures of such metals;

(b) depositing said charged particles on a receiver surface thereby forming said developed electrographic image pattern; and (c) contacting the developed image pattern while on the receiver with a high gain chemical redox amplification composition.

7. A method according to claim 6 wherein said high gain chemical redox amplification composition is a physical development composition.

8. A method according to claim 6, wherein said carrier is a liquid and said metal is selected from the group consisting of copper, silver, cobalt, nickel, rhodium, tellurium, palladium and gold, including alloys and mixtures of such metals.

9. A method of amplifying a developed image pattern formed in an electrophoretic migration imaging process comprising the steps of:

(a) subjecting an electrically photosensitive material positioned between at least two electrodes to an applied electric field, wherein said electrically photosensitive material contains a catalyst or catalyst precursor which is a metal or metal compound and said metal is selected from the group of metals forming groups VIII and IB of the Periodic Table, including alloys and mixtures of such metals;

(b) exposing said material to an image pattern of radiation to which the material is photosensitive, thereby obtaining a developed image pattern on at least one of said electrodes; and (c) contacting the developed image pattern with a high gain chemical-redox amplification composition.

10. A method according to claim 9 wherein said high gain chemical-redox amplification composition is a physical development composition.

11. A method according to claim 10, wherein said metal is selected from the groups consisting of copper, silver, cobalt, nickel, rhodium, tellurium and palladium, including alloys and mixtures of such metals.

12. An electrographic marking particle comprising an electrically photosensitive particle and a catalyst or catalyst precursor which is a metal or metal compound and said metal is selected from the group of metals forming groups VIII and IB of the Periodic Table, including alloys and mixtures of such metals.

13. An electrographic marking particle as in claim 12, wherein said marking particle also contains a colorant.

14. An electrographic marking particle as in claim 12, wherein said metal is selected from the group consisting of copper, silver, cobalt, nickel, rhodium, tellurium, gold and palladium, including alloys and mixtures of such metals.

15. An electrographic developer composition comprising a carrier and a marking particle containing an electrically photosensitive material and a catalyst or catalyst precursor which is a metal or metal compound, wherein said metal is selected from the metals forming groups VIII and IB of the Periodic Table, including alloys and mixtures of such metals.

16. An electrophotographic developer as in claim 15, wherein said carrier is a dielectric liquid.

17. An electrographic developer composition as in claim 15, wherein said metal is selected from the group consisting of copper, silver, cobalt, nickel, rhodium, gold, tellurium and palladium, including alloys and mixtures of such metals.

18. An electrographic developer composition as in claim 15, wherein said carrier is a dry material and said metal is selected from the group consisting of copper, tellurium, cobalt, nickel, rhodium, gold and palladium, including alloys and mixtures of such metals.

* * * * *